US005950583A

United States Patent [19]

Kraxner et al.

[11] Patent Number: 5,950,583

[45] Date of Patent: Sep. 14, 1999

[54] VALVE GEAR OF AN INTERNAL-COMBUSTION ENGINE

[75] Inventors: Dieter Kraxner, Wurmberg; Dietmar Schwarzenthal, Ditzingen; Joachim Gruenberger, Sachsenheim, all of Germany

[73] Assignee: Dr. Ing. H.C.F. Porsche AG, Germany

[21] Appl. No.: 09/066,583

[22] Filed: Apr. 27, 1998

[30] Foreign Application Priority Data

Apr. 25, 1997 [DE] Germany ..... 197 17 537

[51] Int. Cl.[6] ..... F01L 1/14; F01L 13/00

[52] U.S. Cl. ..... 123/90.16; 123/90.48

[58] Field of Search ..... 123/90.16, 90.15, 123/90.17, 90.48, 90.49, 90.5, 90.55, 198 F

[56] References Cited

U.S. PATENT DOCUMENTS

| | | | |
|---|---|---|---|
| 5,343,833 | 9/1994 | Shirai | 123/90.16 |
| 5,488,934 | 2/1996 | Shirai et al. | 123/90.16 |
| 5,603,293 | 2/1997 | Schwarzenthal | 123/90.16 |
| 5,603,294 | 2/1997 | Kawai | 123/90.16 |
| 5,615,651 | 4/1997 | Miyachi | 123/198 F |
| 5,651,335 | 7/1997 | Elendt et al. | 123/90.16 |
| 5,694,894 | 12/1997 | Allen | 123/90.16 |
| 5,709,180 | 1/1998 | Spath | 123/90.16 |
| 5,782,216 | 7/1998 | Haas et al. | 123/90.16 |

FOREIGN PATENT DOCUMENTS

| | | | |
|---|---|---|---|
| 515520 | 12/1994 | European Pat. Off. | 123/90.16 |
| 0 779 411 A1 | 6/1997 | European Pat. Off. . | |
| 35 26 542 A1 | 2/1986 | Germany . | |
| 4405189 | 8/1995 | Germany | 123/90.16 |
| 196 22 174 A1 | 6/1997 | Germany . | |
| 196 06 054 A1 | 8/1997 | Germany . | |
| 2 162 246 | 1/1986 | United Kingdom . | |
| 91/12413 | 8/1991 | WIPO . | |

*Primary Examiner*—Weilun Lo

*Attorney, Agent, or Firm*—Evenson, McKeown, Edwards & Lenahan, P.L.L.C.

[57] ABSTRACT

An internal-combustion engine valve gear has at least two adjacent stroke transmitting elements which, by way of a hydraulically displaceable coupling element, in a coupled position can be displaced with respect to one another and, in the uncoupled position, can be displaced independently of one another. The stroke transmitting elements interact with the cam of a camshaft having different cam paths which interact with different stroke courses with the stroke transmitting elements. In order to avoid undefined switching conditions in the operation of the internal-combustion engine and, during each switching operation have sufficient time for the displacement of the coupling element, this coupling element interacts with a locking element which locks and unlocks the coupling element as a function of the cam path.

12 Claims, 5 Drawing Sheets

VALVE GEAR OF AN INTERNAL-COMBUSTION ENGINE

BACKGROUND AND SUMMARY OF THE INVENTION

This application claims the priority of German application 197 17 537.6, filed Apr. 25, 1997, the disclosure of which is expressly incorporated by reference herein.

The present invention is based on a valve gear of an internal-combustion engine, and more particularly, to a valve gear having at least one charge cycle valve which is acted upon by a camshaft by way of a cam having at least two cam paths with different cam courses. A bucket tappet acts between the cam and the charge cycle valve and has at least two stroke transmitting devices which interact with different cam paths of the cam, of which one stroke transmitting element interacts with the valve stem of the charge cycle valve and the other stroke transmitting element interacts with a spring element whose spring effect on the stroke transmitting element is directed to the camshaft. The two stroke transmitting elements are coupled with one another by a displaceable coupling element in a first switching position and, in a second switching position, are movable independently of one another.

A valve gear is described, for example, in EP 0 515 520 B1 and has a tappet consisting of two concentric bucket elements. The interior bucket element of these elements rests with its one face against the valve stem of the charge cycle valve. The tappet interacts with the cam of a camshaft which has three partial cams with different cam plates. The two exterior cam plates have the same stroke course and act upon the exterior bucket element. The central partial cam has a stroke course which deviates from the former, has a lower stroke height and acts upon the interior bucket element.

The two concentric bucket elements in the known arrangement can be coupled with one another by the hydraulic action upon a coupling element or, in a second switching position of this coupling element, can be moved independently of one another. In the coupled switching position, the two bucket elements are connected with one another so that these follow the stroke course of the partial cams with a larger stroke. This movement is transmitted to the valve stem by way of the coupling element and the interior bucket element. In the second switching position of the coupling element, the two bucket elements can be moved independently of one another. In this switching position, the valve stem interacts with the central partial cam with the lower stroke.

The known exterior disk element follows the stroke movement of the exterior partial cams, in which case there is, however, no connection to the interior bucket element or to the valve stem. In the case of these tappets, however, the coupling element can be adjusted at any time out of its momentary switching position, as the result of a hydraulic action. Generally speaking, the displaceablility of the coupling element will exist only if all partial cams, interacting with the pertaining bucket element, are in their base circle phase because the coupling element is freely movable only in this switching position. The admission of pressure to the coupling element takes place independently thereof so that, under certain circumstances, the time for a complete adjustment of the coupling element from one switching position into another is not sufficient. This may undesirably stress the edges and result in high wear. In certain circumstances and in the event of an insufficient displacement, the coupling element can be pressed back by the forces acting out of the valve gear. As a result, after a partial stroke, the valve strikes back into the valve seat in an undamped manner which causes very disturbing noises and additional wear.

DE 44 05 189 A1 shows a valve gear of an internal-combustion engine which has a tappet for a charge cycle valve which can be switched off. The tappet has a coupling element for activating and deactivating the pertaining charge cycle valve. This coupling element is longitudinally slidable and has a bore into which the valve stem can dip in a switching position. In this switching position, a stroke movement of the tappet is possible which, however, is not transmitted to the valve stem. The displacement of the coupling element is possible only within defined cam paths. For this purpose, the coupling element interacts with a blocking device which consists of a resilient blocking tongue and an actuating pin. In defined positions, the resilient blocking tongue engages in the coupling element. The sensing pin takes measurements on a cam contour of the pertaining cam and transmits these measurements to the blocking element. Thereby, a relieving of the blocking element and therefore a displacing of the coupling element is possible only in defined cam path areas.

An object of the invention is to improve a valve gear of an internal-combustion engine such that undefined switching positions are avoided and the coupling element can always be changed securely from one of its end positions into the other end position. This simultaneously achieves the object of avoiding undesirable component stress by an insufficient carrying action.

According to the present invention, these objects have been achieved by providing that the coupling element has a locking contour which interacts with a locking element guided in the bucket tappet. The locking element interacts with the camshaft such that the coupling element as a function of the cam path can be locked in a first cam path range in a switching position and can be released in a second cam path range so that the coupling element can be displaced into the other switching position, and the locking element is acted upon by the spring element.

By constructing a locking contour on the coupling element which interacts with a locking element, which releases or blocks the coupling element as a function of the cam path, the coupling element can be displaced with assurance only within defined cam path areas. This operation assures that sufficient time always remains for the displacement of the coupling element during the base circle phase of the pertaining cam so that a secure switching-through of the coupling element will occur from one switching position into the other switching position. As the result of the direct engagement of the locking element into a locking contour constructed on the coupling element, component expenditures are also reduced which, on one hand, saves components and, on the other hand, saves installation space. The spring action upon the locking element further assures that the locking element is always loaded in the direction of the assigned cam contour. Also in the case of faulty positions of the coupling element, the locking element thus cannot jam but can be pressed over into a secure position against the effect of the spring element.

The cam-path-dependent blocking or releasing of the coupling element can advantageously be constructed such that a sensing element scans a cam contour of the camshaft and transmits it to the locking element. Thereby, in a first cam path area, the locking element locks the coupling element and releases it in a second cam path area. The locking element can, for example, scan an outside contour of the cam path or of the cam area. The locking of the coupling element can advantageously and without any additional components, take place by arranging the unlocking contour in the form of an elevation or indentation on the cam in the scanning area of the locking element. Thereby, the locking element is constructable in a particularly simple and low-cost manner as a longitudinally movable locking pin which engages directly in the locking contour on the coupling element.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
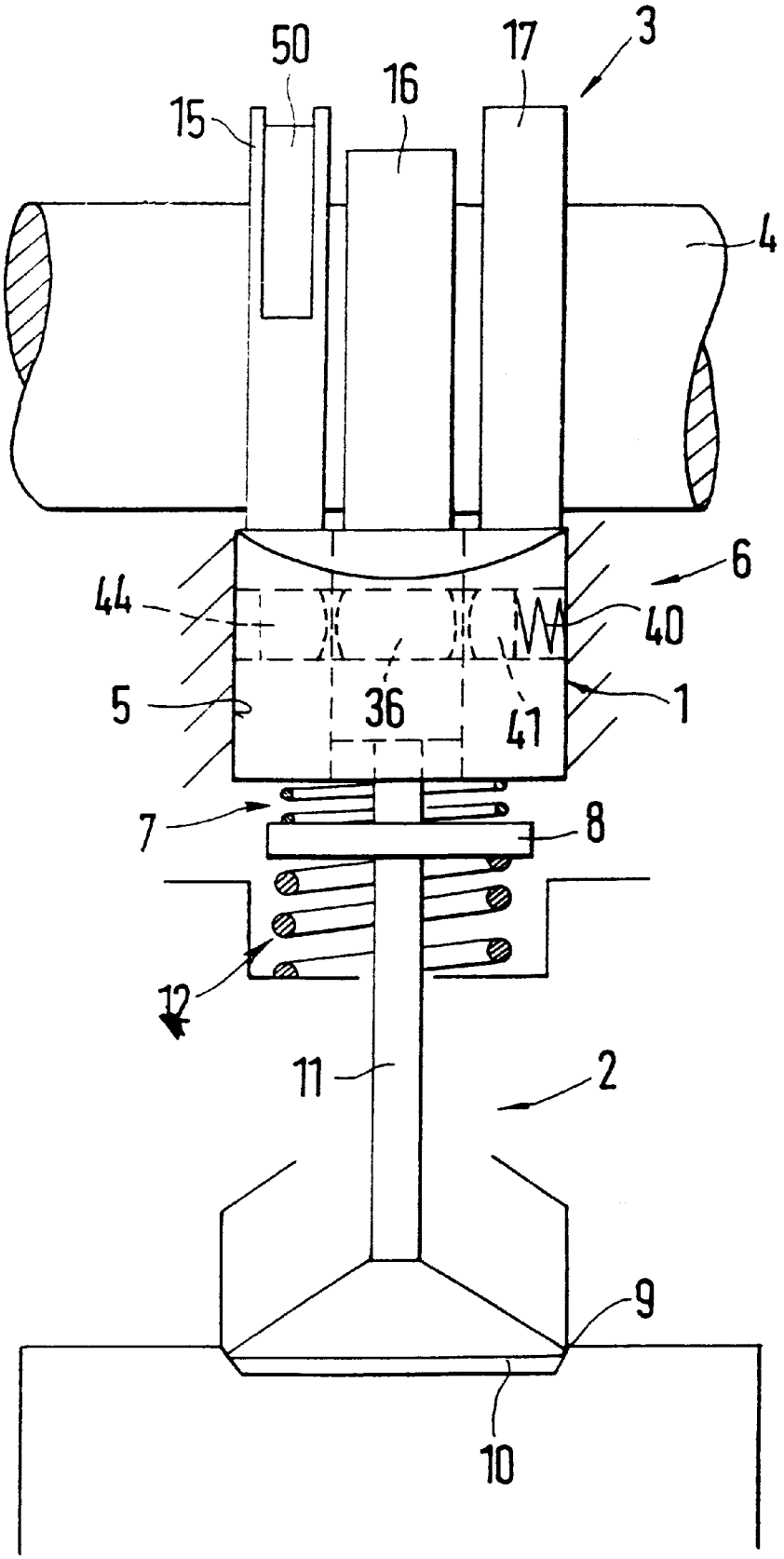
FIG. 1 is a simplified schematic representation of the valve gear according to the present invention.

The valve gear illustrated in FIG. 1 of an internal-combustion engine has a cylindrical tappet 1 (bucket tappet) which is arranged coaxially to a switchable charge cycle valve 2 and is actuated by a cam 3 of a camshaft 4. The tappet 1 is inserted into a bore 5 of a cylinder head 6 and is supported by way of a pressure spring 7 on a valve spring retainer 8. The valve 2 (charge cycle valve) comprises a valve disk 10 interacting with a valve seat 9 of the cylinder head 6 as well as a valve stem 11 on which the valve spring retainer 8 is mounted. Between the valve spring retainer 8 and the cylinder head 6, a valve spring 12 biases the valve 2 in the closed position. Of course, the present invention also contemplates that the pressure spring 7 not be supported on the valve spring retainer 87 but on the cylinder head 6.

The tappet 1 has two concentric bucket elements 13, 14 each of which interact with cam plates 15 to 17 with different stroke profiles of the cam 3 (hereinafter, also referred to as cam areas or partial cams). The two exterior cam areas 15, 17 have an identical construction; i.e., the same stroke height and phase position. These cam areas 15, 17 interact with the exterior one of the two bucket elements 13. In comparison to the two exterior cam areas 15 and 17, the center cam area 16 has a lower stroke height and interacts with the interior bucket element 14. This bucket element 14 interacts by way of a known type of hydraulic valve clearance compensating element (HVA) 18, illustrated in detail in FIG. 2, with the valve stem 11 of the charge cycle valve 2.

Figure 2:
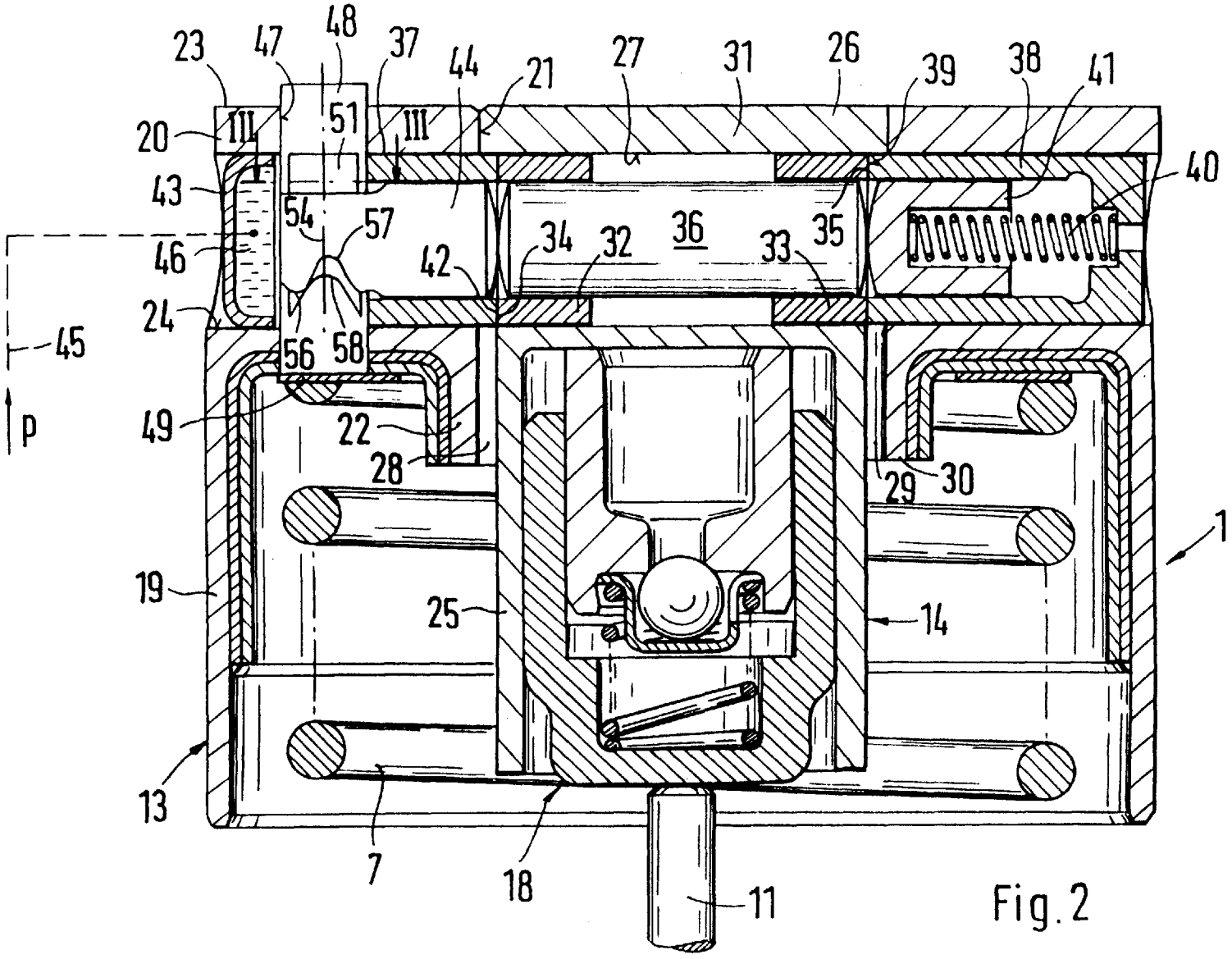
FIG. 2 is a sectional view of a stroke transmitting element constructed as a valve tappet for the valve gear of FIG. 1.

The exterior bucket element designated generally by numeral 13 has an approximately cup-shaped housing 19 with a bottom 20 which faces the cam 3. The bottom 20 has a continuous opening 21 which is surrounded on the interior side of the bottom 20 by a surrounding edge 22. In parallel to its exterior side, the bottom 20 is penetrated by a radially extending bore 24 which intersects with the opening 21. A cup-shaped housing 25 of the interior bucket element 14 is inserted into the opening 21. The bottom 26 of the housing 25 faces the central cam area 16 and is penetrated by a bore 27 which, in the operating position of the tappet 1 illustrated in FIG. 2, is aligned with the bore 24 of the exterior bucket element 13.

Starting from the area of the bore 27, the exterior side of the housing 25 is provided with two parallel flats 28, 29 which extend to the end 30 of the housing facing away from the cam so that only the area 31 above the bore has a cylindrical construction along its entire circumference. The flats 28, 29 are constructed such that they extend at a right angle to the axis position of the bores 24, 27. The hydraulic valve clearance compensating element 18 is guided in the interior of the housing 25. The bottoms 20, 26 of the two bucket elements are curved in a barrel shape on their exterior sides in the traveling direction of the cam 3.

Two mutually opposite guide sleeves 32, 33 are inserted into the interior of the bore 27. The faces 34, 35 of the guide sleeves 32, 33 close off flush with the flats 28, 29. These guide sleeves 32, 33 receive a coupling element 36 in the form of a cylindrical pin and the like whose length corresponds to the distance between the two exterior faces 34, 35 of the guide sleeves.

In the bore 24 of the exterior bucket element 13, one guide sleeve 37, 38 respectively is arranged in the two opposite bore sections. The right-hand guide sleeve 38, as viewed in FIG. 2, has an approximately cup-shaped construction and is dimensioned such that it projects into the opening 21 and its open face 39 abuts the face 35 of the guide sleeve 33. One end of a pressure spring 40, whose opposite end rests on a piston 41 guided in the interior of the guide sleeve 38, is supported on the interior side of the guide sleeve 38. The face of this piston 41 rests against the opposite face of the coupling element 36.

The opposite guide sleeve 37 also projects into the opening 21 and, by way of its face 42, adjoins the adjacent face 34 of the guide sleeve 32. On its opposite face, the guide sleeve 37 is closed off by a cup-shaped insert 43. In the interior of the guide sleeve 37, a piston 44 is longitudinally movably guided whose face rests on the opposite face of the coupling element 36. This arrangement of the guide sleeves 37, 38 and their interaction with the flats 28, 29, prevents rotation of the exterior bucket element 13 relative to the interior bucket element 14. Simultaneously, the guide sleeves 27 and 28 in connection with the area 31 of the housing 25 are used as a stop which limits the stroke of the exterior bucket element in direction of the cam 3 and relative to the interior bucket element.

A bore, which is connected by way of the exterior side of the exterior bucket element 13 with a controlled pressure line 45 arranged in the cylinder head 6, leads into the guide sleeve 37. The piston 44 and the insert 43 form a pressure space 46 in the interior of the guide sleeve 37 into which the pressure line 45 leads. By admitting pressure medium (e.g., lubricating oil) to the pressure space 46, the piston 44 can be displaced as a function of the amount of the pressure p such that the piston 44 displaces the coupling element 36 and the piston 41 against the effect of the pressure spring 40.

Between the guide sleeve 37 and the insert 43, the bottom 20 of the exterior bucket element 13 is penetrated by a bore 47 which intersects with the radial bore 24. In the bore 47, a locking pin 48 is longitudinally movably guided and is supported on the pressure spring 7 by way of a disk 49. The locking pin 48 is slidably but sealingly guided in the bore 47.

The length of the locking pin 48 is selected such that the locking pin projects beyond the top side 23 of the exterior bucket element 13 if, under the effect of the pressure spring 7, the disk 49 rests against the interior side of the bottom 23. In the rotating position of the camshaft 4, the locking pin 48 in the process projects in a groove-shaped indentation 50 extending along a portion of the circumference of the partial cam 15.

The central area of the locking pin 48 has two opposite flats 51, 52. In its face facing the locking pin 48, the piston 44 has an indentation 53 which is arranged such that two opposite sections 54, 55 with flat parallel interior sides are constructed on the piston 44. These sections 54, 55 reach at a narrow distance around the flats 51, 52 and thereby prevent rotation of the locking pin 48. Furthermore, on their underside, the two sections 54, 55 each have a rounded section 56 which starts at the free face and which changes into a parabolically extending indentation 57. A parabolically constructed elevation 58 at the lower end of the flats 51, 52 also projects into these parabolically-shaped indentations 57.

In the switching position illustrated in FIG. 2, the pistons 44, 41 and the coupling element 36 are in their left end position whereby the interior and the exterior bucket element 13, 14 can be moved uncoupled and freely with respect to one another in the axial direction. In this switching position, the charge cycle valve 2 is operated by way of the interior bucket element 14 and the partial cam, while the exterior bucket element 13 acted upon by the partial cam 15 and 17 is freely movable relative to the interior bucket element. If the charge cycle valve is to be operated with a larger stroke corresponding to the course of the stroke of the exterior partial cams 15 and 17, the pressure p in the pressure space 46 is increased so that the piston 44 is acted upon toward the right against the force of the pressure spring 40. However, the movement of the piston 44 is prevented as a function of the rotating position of the camshaft 4 by the interaction of the piston 44, the locking pin 48 and the indentation 50 in the partial cam 15, which indentation 50 extends from the transition of the base circle phase along the entire stroke phase of the partial cam. The locking pin 48 can therefore dip into the indentation 50 along the entire stroke phase and the respective transition to the base circle phase. The start and the end of the indentation change constantly into the surface contour of the partial cam so that, at the start of the base circle phase, the locking pin 48 is pressed downward against the effect of the pressure spring 7 and, at the end of the base circle phase, the locking pin 48 is pressed upward by the effect of the pressure spring 7.

The three partial cams are constructed such that their base circles have the same radius and., at least along the important portion of their circumference, the same angular position. In this context, the base circle phase is the angle of rotation range of a cam in which its circumferential area with a uniform radius (base circle) interacts with the stroke transmitting element (tappet) such that no valve stroke is caused. Furthermore, the stroke phase is the angle of rotation range of a cam in which its elevated area (stroke area) interacts such with the stroke transmitting element (tappet) that the charge cycle valve is operated; i.e, the valve disk lifts off the valve seat.

In the stroke phase of the camshaft, the piston 44 can be displaced toward the right only to such an extent that the respective edges of the parabolic indentations 57 of the piston 54 and of the parabolic elevations 58 of the locking pin 48 rest against one another in a blocking manner. The indentations 57 and the elevations 58 are dimensioned such that, the piston 44 does not yet project into the bore 27 so that the interior and the exterior bucket element continue to be freely movable with respect to one another in the axial direction. If the base circle area of the partial cam 15 is left or departed from during rotation of the camshaft, the locking pin 48 at the end of the indentation 50 is pressed downward against the effect of the pressure spring 7 so that the parabolic indentations 57 of the piston and the parabolic elevations 58 of the locking pin 48 will disengage. As a result, the piston 44 is released, that is, it is freely movable.

If the pressure p in the pressure space 46 is high enough, the piston 44 is displaced toward the right against the effect of the pressure spring 40 so that the piston 44 projects into the bore 27 or the guide sleeve 32 while the coupling element 36 projects into the guide sleeve 38. In this switching position of the pistons 44, 41 and of the coupling element 36, the interior and the exterior bucket element 13, 14 are coupled with one another so that the interior bucket element 14 follows the larger stroke of the exterior bucket element 13 and the operation takes place of the charge cycle valve with the larger stroke.

When, as the result of a corresponding control of the pressure line 45, the pressure p in the pressure space 46 is lowered, the piston 44 is acted upon in the opposite direction, toward the right, by way of the coupling element 36, the piston 41 and the pressure spring 40. As long as the locking pin 48 dips into the indentation 50, this movement is prevented by the mutual contact of the edges of the parabolic indentations 57 and of the parabolic elevations 58 so that a change-over outside the base circle phase of the partial cams 15 to 17 is prevented. A further displacement of the coupling element 36 and of the piston 44 is possible only if the locking pin 48 at the end of the indentation 50 is pressed downward by the running-up partial cam 15 against the effect of the pressure spring 7 so that the parabolic indentations 57 and the parabolic elevations 58 will disengage.

Should the piston 44 not be moved completely into one of its end positions during the displacement into one of the two directions, for example, in the event of fluctuations of the pressure in the pressure space 46, this piston 44 will be pressed into one of the two end positions by the wedge-type interaction of the parabolic indentations 57 and of the parabolic elevations 58 or by the interaction of the rounded sections 56 and of the parabolic elevations 58, as soon as the locking pin 48 arrives in the area of the indentation 50 and is lifted by the effect of the pressure spring 7. This construction of the interacting contours of the piston 44 and of the locking pin 48 achieves a forced control because of the wedge effect which compensates a securing function in the event of unintentional or unforeseen pressure fluctuations in the pressure space 46.

Independently thereof, damage to the locking pin 48 is prevented in all switching and intermediate positions of the piston 44 by the interaction with the pressure spring 7. This is because, at any time, the locking pin 48 can be pressed in the downward direction at the end of the indentation 50 by the running-up partial cam 15 against the effect of the pressure spring 7. A jamming of the locking pin 48 and a possibly resulting shearing-off are securely prevented.

Figure 4:
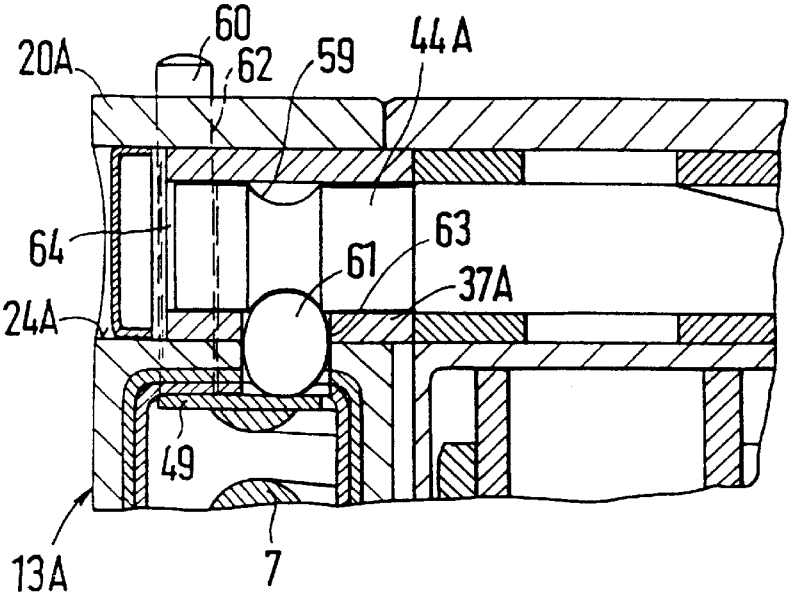
FIG. 4 is a partial sectional view of a second embodiment of the stroke transmitting element constructed as a bucket tappet.

The second embodiment of the tappet illustrated in FIG. 4 differs from the above-described embodiment essentially in the construction of the piston 44A and the locking element. In this second embodiment, the locking piston 44A has a cylindrical construction and a surrounding ring-shaped indentation 59 of a rounded cross-section in its central area.

The locking element has a two-part construction and consists of a locking pin 60 and a second locking part 61. The locking pin 60 is longitudinally movably guided in a bore 62 illustrated in broken line which extends through the bottom 20A of the exterior bucket element 13A. The bore 62 is arranged to be offset with respect to the bore 24A so that it does not intersect with the latter.

As in the above-described embodiment of FIG. 2, the locking pin 60 rests on one side against the partial cam 15 and rests on the other side by way of the disk 49 against the pressure spring 7. Furthermore, the bottom 24A is penetrated on its interior side by a bore 63 which extends into the interior of the guide sleeve 37A. The second locking part 61 is guided in the bore 63 and is either constructed as a locking ball or, as illustrated, as a short cylindrical structural element with spherical faces. The second locking part 61 acts as a function of the switching position of the piston 44A, analogously to the previous embodiment, in a blocking or releasing manner either with the surrounding ring-shaped indentation 59 or the face 64 of the piston 44A.

In the switching position of the tappet or of the piston 44A illustrated in FIG. 4, the second locking part 61 is pressed upward by the effect of the pressure spring 7 via the disk 49 such that it projects into the ring-shaped indentation 59 and prevents a displacement of the piston 44A. Only when, in a corresponding rotating position (base circle phase) of the camshaft, the locking pin 60 is pressed downward by the running-up partial cam 15 against the effect of the pressure spring 7, the second locking part 61 can also be moved downward so that a movement of the piston 44A toward the right is released.

When, after the change-over operation, the piston 44A is in its right end position, its face 64 will interact with the second locking part 61 such that a pushing-back into the first (left) switching position is possible only if the disk 49 is pressed downward by the locking pin 60 against the effect of the pressure spring 7 and the second locking part 61 is also moved downward. Otherwise, the face 64 of the piston 44A will press against the end of the second locking part 61, which projects into the bore 63 and the guide sleeve 37A, to prevent displacement. A pushing-back into the first switching position is therefore also possible only in the base circle phase if the locking pin 60 is pressed downward by the partial cam 15 and does not project into the indentation 50 of the partial cam.

The embodiment of FIG. 4 has the advantage that the pressure space on the piston 44A is penetrated by the bore 63 only on one side while the bore 62 does not intersect with the pressure space. A leakage from the pressure space in the direction of the camshaft is therefore prevented.

Figure 5:
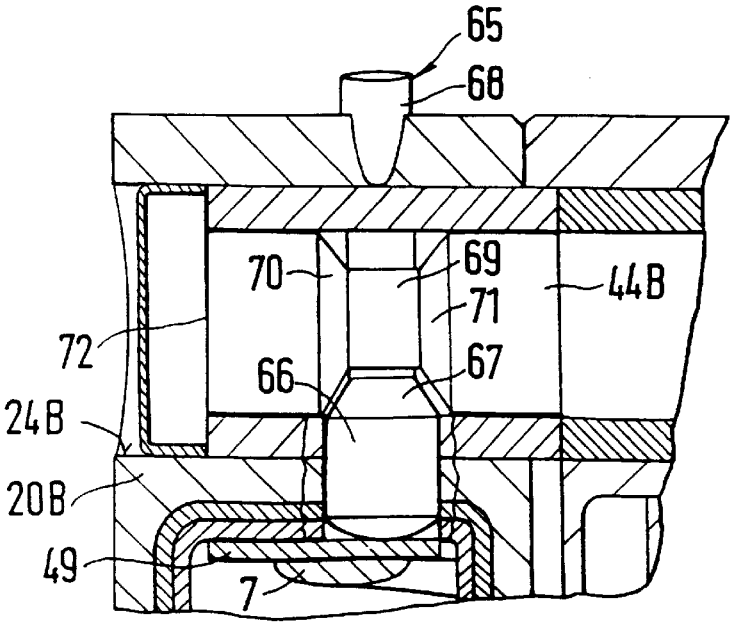
FIGS. 5 to 7 are partial sectional views of three other embodiments.

In the third embodiment of the invention illustrated in FIG. 5, the locking element is again constructed as a one-piece locking pin 65 which completely penetrates the bore 24B. The end 66 of the locking pin 65, which is guided in the lower portion of the bottom 20 and interacts with the disk 49 as well as with the pressure spring 7, has a larger diameter. This end 66 of a larger diameter has a conical transition 67 into a section 68 of a smaller diameter which penetrates the exterior side of the bottom 20B and interacts with the partial cam 15. In its central area, the piston 44B also has a ring-shaped indentation 69 whose edges 70 and 71 have a conical construction.

In the first (left) switching position of the tappet or of the piston 44B illustrated in FIG. 5, the free end of the locking pin 65 projects into the indentation of the partial cam 15 (not shown), with the conical transition 67 projecting into the surrounding indentation 69. Because of the placement of the conical edge 70 on the conical transition 67, a displacement of the piston 44B is prevented in this switching position of the locking pin 65. Only when, as the base circle phase is reached, the locking pin 65 is pressed downward by the partial cam 15 against the effect of the pressure spring 7, are the conical indentation 69 and the conical transition 67 disengaged to allows the piston 44B to be displaced.

In the second (right) end position of the piston 44B, its face 72 interacts with the conical transition 67 such that a pushing-back into the first (left) end position is possible only if the locking pin 65 is pressed downward against the effect of the pressure spring; i.e., within the base circle phase of the partial cam 15. As long as the locking pin 65 projects with its free end into the indentation 50, a displacement is prevented by the contact of the face 72 on the conical transition 67.

Figure 6:
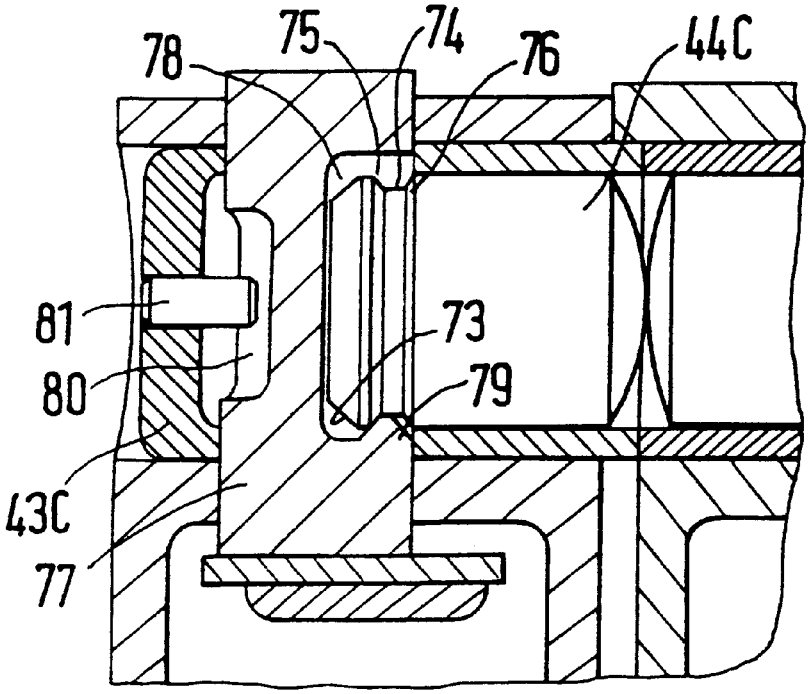

In the embodiment shown in FIG. 6, the piston 44C has a first conical section 73 which starts from the face and which is adjoined at a distance by a surrounding ring-shaped indentation 74 with conical edges 75 and 76. The locking pin 77 again has a cylindrical construction and, on the circumferential side facing the piston 44C, has an indentation 78 into which the piston 44C dips as a function of the switching position. On its lower side, the indentation 78 has a hump-shaped extension 79 which, in the switching position of the piston 44C illustrated in FIG. 6, engages in the surrounding groove 74. As in the previously described embodiments, this hump 79 prevents in an interaction with the ring-shaped indentation 74 or with the face 73 of the piston 44C displacement of the piston 44C during the stroke phase of the partial cam 15.

On the opposite side, another oblong indentation 80 is constructed in the locking pin 77, and into which a pin 81 engages to be guided in the guide sleeve 43C and to prevent rotation of the locking pin.

Figure 7:
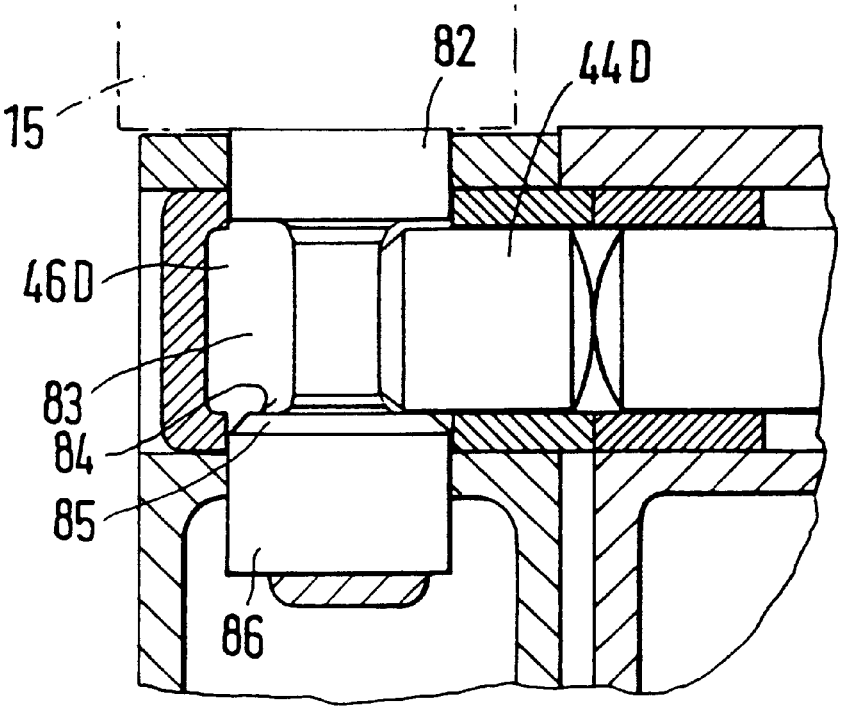

The locking pin 82 in the embodiment shown in FIG. 7 has a surrounding indentation 83 into which the piston 44D engages in the illustrated switching position. The locking due to the interaction between the locking pin 82 and the piston 44D and in the illustrated switching position takes place, not by form closure but, by force closure. For this purpose, the ring-shaped indentation 83 has a plane wall section 84 on its lower end, with a conical transition section 85 adjoining the wall section 84. In the first (left) end position of the piston 44D illustrated in FIG. 7, the piston 44D projects into the indentation 83 of the locking pin 82 such that the plane section 84 rests against the circumference of the piston 44D.

By appropriately tuning or sizing the pressure spring 7, the frictional force on the basis of the effect of the pressure spring 7 is ensured to exceed the maximally achievable force on the basis of the pressure effect in the pressure space 46D as long as the locking pin 82 is not pressed downward by the partial cam 15. The movement of the piston 44D is therefore blocked by the frictional engagement with the locking pin 82. In the second right-end position, the face of the piston 44D interacts with the lower section 86 of the locking pin 82.

Figure 3:
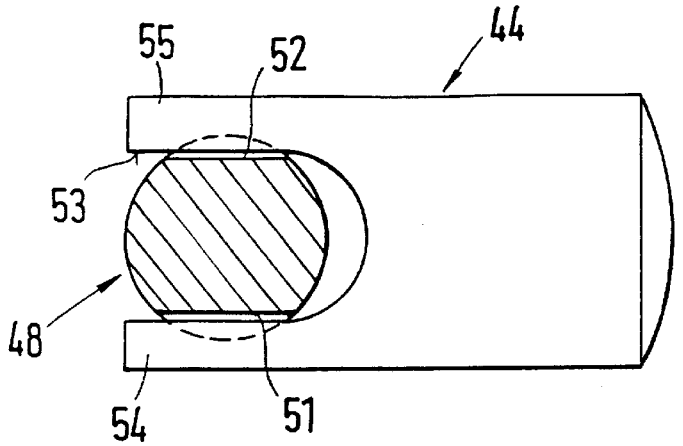
FIG. 3 is a sectional view along line III—III of FIG. 2.
Figure 8:
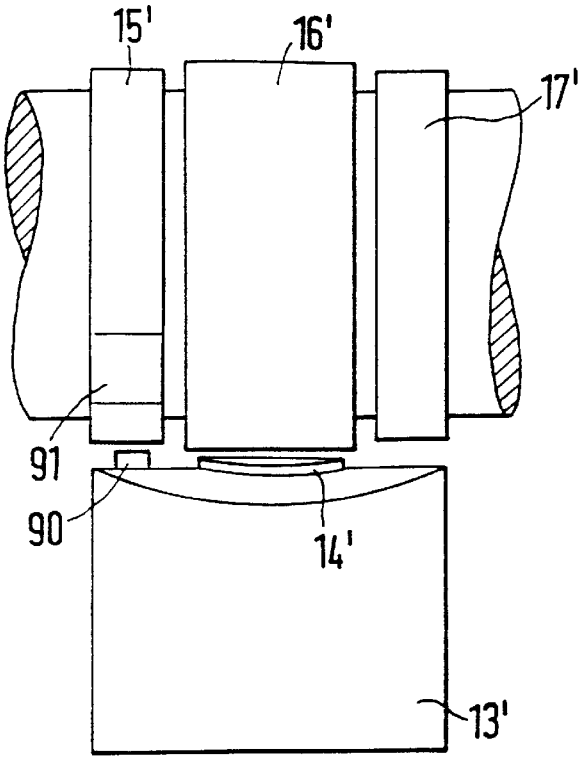
FIGS. 8 and 9 are schematic representations of modifications of the unlocking contour.
Figure 9:
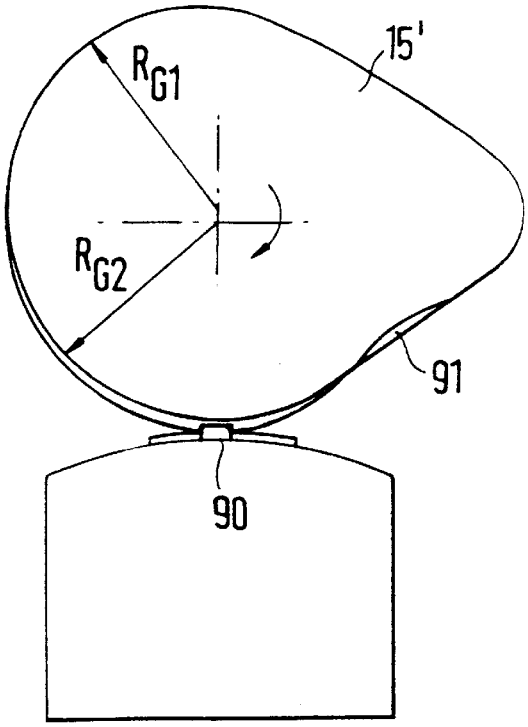

The modification of the above-described embodiments illustrated in FIGS. 8 and 9 differs by a changed locking/unlocking contour on the partial cam 15 and the bucket elements 13', 14'. That is, the bottoms of the two bucket elements are not aligned on their side facing the respective partial cam. In the base circle phase of the cam illustrated in FIGS. 8 and 9, the interior bucket element 14' protrudes with respect to the exterior bucket element 13'. This position of the two bucket elements is ensured, for example, by the guide sleeves 37, 38 which are shown in detail in FIG. 3 and are used as stop devices, in conjunction with the top side of the bore 27.

In a first section relative to the rotating direction, the base circle radius $R_{G1}$of the partial cam 15' is coordinated with the protrusion of the interior bucket element such that the locking pin 90 is pressed downward, and the movement of the piston is released analogously to the previous embodiments. Instead of the locking pin 90, any of the above-described locking elements can also be used.

After an angular range of the base circle phase coordinated with the required displacement time, the base circle radius of the partial cam 15' is reduced ($R_{G2}$) so that the locking pin can dip into the resulting clearance on the partial cam 15' and prevents the displacement of the piston. In order to prevent a displacement of the piston in the transition of the base circle phase into the elevation phase of the partial cam 15', an indentation 91 in the partial cam 15' is formed in this transition area into which the locking pin 91 can dip and lock the piston. After passing through this indentation 1, the piston is locked by the no longer aligned position of the radial bores in the interior and exterior bucket element.

Figure 10:
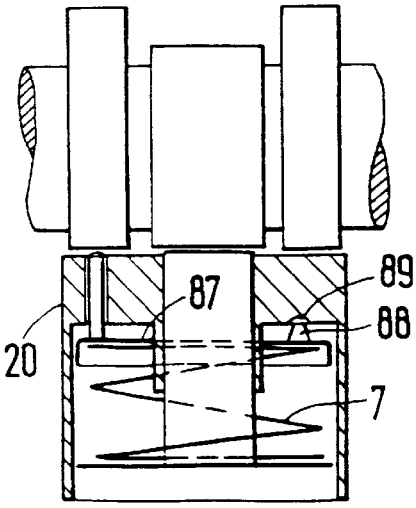
FIGS. 10 and 11 are simplified representations of another modification of the above-described embodiments.
Figure 11:
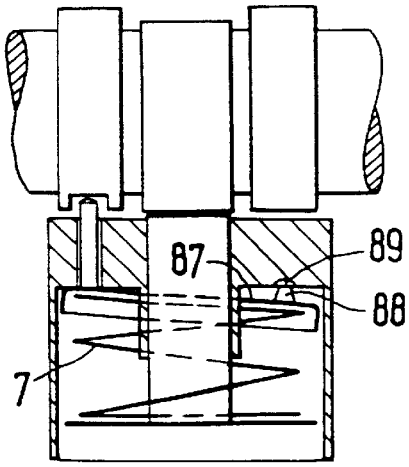

FIGS. 10 and 11 show a modification of the above-described embodiments in the case of which the pressure spring 7 rests against the interior side of the bottom 20 with the insertion of a disk element 87. On the side facing away from the respective locking pin (such as the locking pin 48), the disk element 87 has two hump-shaped extensions 88 which each project into an indentation 89 on the interior side of the bottom 20. The height of the humps 88 is dimensioned such that the disk element is aligned parallel to the bottom 20 when the locking pin is pressed into its lower position by the partial cam (as in FIG. 10). This prevents an inclination of the spring in the principal load case (stroke phase of the partial cam) and ensures a more uniform load during the course of the stroke.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Valve gear of an internal-combustion engine having at least one charge cycle valve which is arranged to be acted upon by a camshaft via a cam having at least two cam plates with respective different stroke profiles, comprising a bucket tappet configured to act between the cam and the charge cycle valve and having at least two stroke transmitting devices operatively arranged to interact with the different stroke profiles of the cam plates, one of the stroke transmitting devices being configured to interact with a valve stem of the charge cycle valve and another of the stroke transmitting devices being configured to interact with a spring element which is operatively arranged to provide a spring effect on the another of the stroke transmitting devices directed to the camshaft, a displaceable coupling element for operatively coupling the at least two stroke transmitting devices in a first switching position and allowing the at least two stroke transmitting devices to be movable independently of one another on a second switching position, wherein a locking element is guided in the bucket tappet and is actable upon by the spring element, and the coupling element has a locking contour configured to interact with the locking element guided in the bucket tappet, said locking element interacting with the camshaft such that the coupling element as a function of the cam path is lockable in a first cam path range in a switching position and is releaseable in a second cam path range so that the coupling element can be displaced into the other switching positions.

2. The valve gear according to claim 1, wherein the locking element is arranged to scan an unlocking contour of the camshaft such that, in the first cam path range, the coupling element is locked and, in the second cam path range, the coupling element is releaseable.

3. The valve gear according to claim 2, wherein the locking element is configured to scan an outer circumference of the associated cam, and the unlocking contour is arranged on the cam in the scanning area of the locking element and is configured as one of an elevation and an indentation.

4. The valve gear according to claim 1, wherein the locking element is a longitudinally movable locking pin arranged to engage in a locking contour on the coupling element.

5. The valve gear according to claim 1, wherein the locking element is arranged to be longitudinally guided in an exterior bucket element comprising one of the stroke transmitting devices.

6. The valve gear according to claim 1, wherein the coupling element is configured to reach at least partially around the locking element.

7. The valve gear according to claim 1, wherein interacting wedge surfaces are formed on the coupling element and on the locking element.

8. The valve gear according to claim 1, wherein the locking element is arranged to be loaded so as, in a locking phase under the effect of the spring element, to project beyond an exterior side of the bucket tappet.

9. The valve gear according to claim 1, wherein the locking element is pressed by the cam against the effect of the spring element in a stroke direction in an unlocking phase.

10. The valve gear according to claim 1, wherein the locking element and the coupling element are arranged to interact at least in one end position thereof in a force-locking manner.

11. The valve gear according to claim 1, wherein the locking element and the spring element are arranged to interact with the insertion of a disk element.

12. The valve gear according to claim 1, wherein the disk element is arranged to rest on a side facing away from the locking element via spacing elements on a bottom of the bucket element comprising one of the stroke transmitting devices.

* * * * *